United States Patent [19]

Young et al.

[11] 4,431,035

[45] Feb. 14, 1984

[54] WOVEN FABRIC WITH COVERED EDGES AND METHOD OF A MANUFACTURE

[75] Inventors: Roger Young, Lincoln; Klaus E. Schoeffler, Newark, both of Del.

[73] Assignee: International Playtex, Inc., Stamford, Conn.

[21] Appl. No.: 163,019

[22] Filed: Jun. 25, 1980

[51] Int. Cl.[3] ..... D03D 35/00

[52] U.S. Cl. ..... 139/383 R; 139/385; 139/421; 139/423; 139/430; 139/118; 139/432

[58] Field of Search ..... 139/383 R, 385, 421, 139/422, 423, 118, 430, 431, 432

[56] References Cited

U.S. PATENT DOCUMENTS

| | | | |
|---|---|---|---|
| 2,492,051 | 12/1949 | Libby | 139/421 |
| 3,000,404 | 9/1961 | Eisen | 139/383 R |
| 3,378,039 | 4/1968 | Vaslet | 139/118 |
| 3,460,580 | 8/1969 | Mosher | 139/118 |
| 3,996,971 | 12/1976 | Griffith | 139/431 |

FOREIGN PATENT DOCUMENTS

| | | | |
|---|---|---|---|
| 2727290 | 8/1976 | Fed. Rep. of Germany | 139/432 |
| 493680 | 10/1938 | United Kingdom | 139/421 |
| 1452191 | 10/1976 | United Kingdom | 139/432 |

*Primary Examiner*—Henry Jaudon

*Attorney, Agent, or Firm*—Stewart J. Fried

[57] ABSTRACT

A fabric woven on a needle loom including a cover thread on the woven edge covering the exterior edge of the woven edge warp thread by a serpentine pattern interlocked with the weft loops and a binder thread knitted at the other edge covering the exterior edge of the knitted edge warp thread. Picot loops formed at both edges of the warp extend diagonally therefrom. A plurality of picot loops at the knitted edge include a non-picot weft loop substantially at the center of the plurality to secure the knitted binder thread to the warp edge.

21 Claims, 4 Drawing Figures

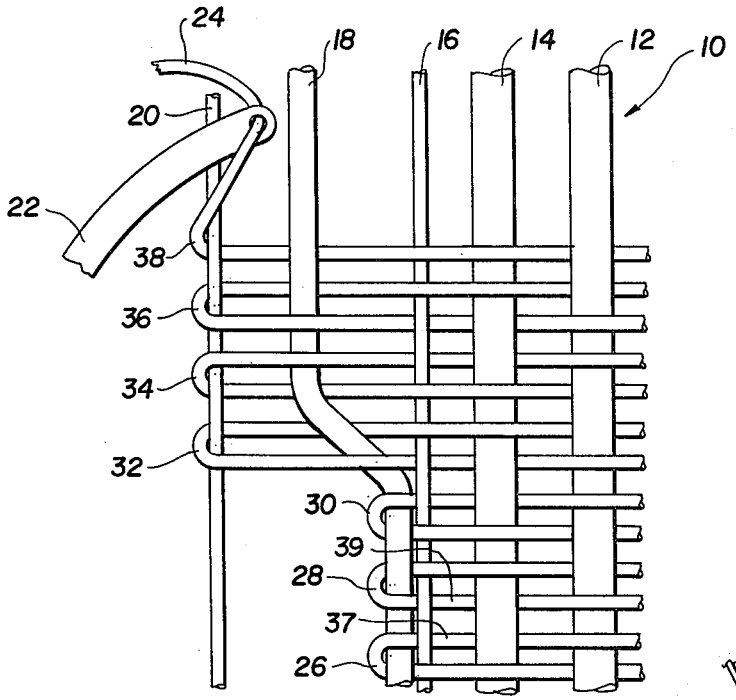
FIG. 1
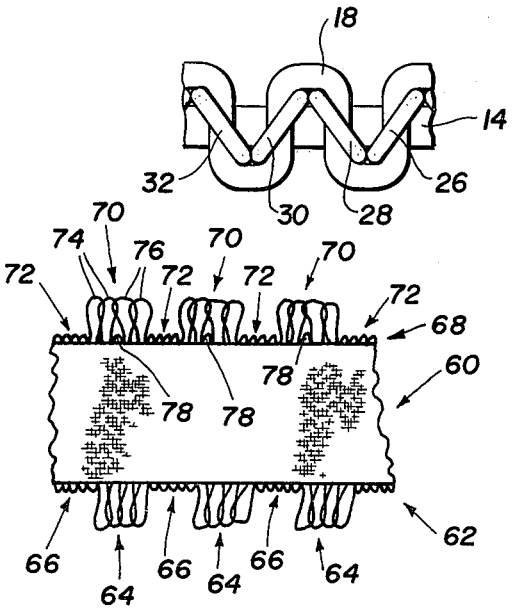
FIG. 2
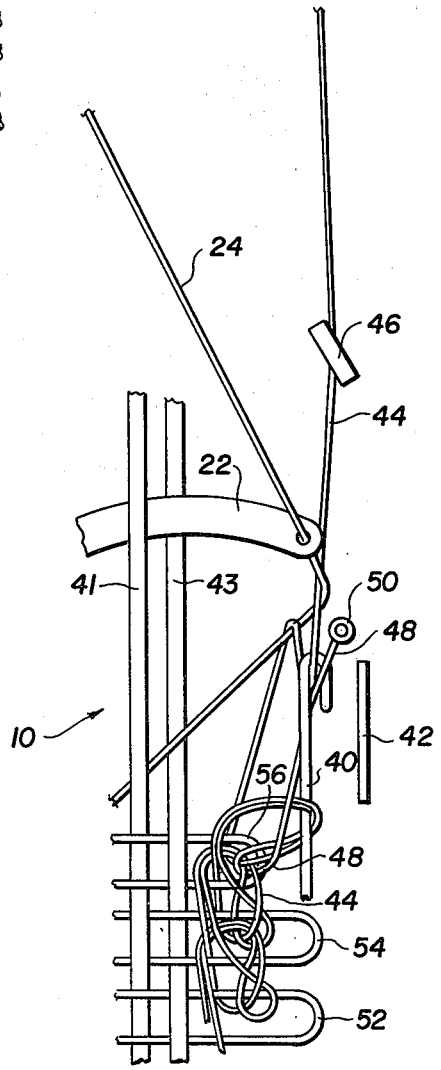
FIG. 3
FIG. 4

WOVEN FABRIC WITH COVERED EDGES AND METHOD OF A MANUFACTURE

BACKGROUND OF THE INVENTION

The present invention relates generally to fabrics and method of fabrication, and more specifically, to an improved fabric and method of fabrication having picot loops along both edges.

Woven fabrics, and more specifically narrow elastomeric fabrics are generally produced economically on needle looms. These looms include a weft insertion needle which inserts a weft thread from one side of the loom to the other wherein it is caught and bound by a knitting needle at the other edge. There are many ways of securing the weft thread at the knitted selvage including (a) knitting the weft thread with itself, (b) knitting a binder thread with itself and interlooping with the weft thread, (c) knitting the weft thread and binder thread together, (d) knitting two binder threads or a binder thread and a catch thread alternately upon themselves and interlooping with the weft thread, or (e) interlooping a binder thread with the weft thread and knitting the binder thread and the lock thread upon themselves. Other needle looms have included, instead of a knitting needle, a wire to engage the weft thread at the second edge during its return trip to the first edge, so as to prevent removal of the weft thread. Also, it should be noted that narrow elastomeric fabric may be produced by a shuttle loom, although the needle loom is faster and therefore more economical.

"Picot" is a word of art used to describe one of a series of small, ornamental loops extending from the edge of a fabric. Picot loops may be formed on the woven edge (the edge at which the weft needle is inserted) by a wire being horizontally inserted adjacent to this edge, as illustrated in U.S. Pat. No. 3,460,583, or by using a horizontal wire manipulated as a warp element in time relationship to the weft needle, as illustrated in U.S. Pat. No. 3,378,039. Picot loops may also be formed at the knitted edge by an element inserted vertically or horizontally to engage and retain the weft thread extended past the selvage edge as illustrated in U.S. Pat. No. 3,996,971 and United Kingdom Pat No. 1,452,191.

A double picot, or picot loops formed on both edges of a fabric, produced on a needle loom have two different types or styles of picot, one on each edge. At the woven edge, the picot loops extend substantially vertically and are known as a plain or common picot. On the knitted side, the picot loops extend diagonally because of the interlooping of the knitted binder thread with the picot loop. The diagonal setting of the picot cause it to flair, which is known as the "French picot." The diverse style of picot on the opposite edges of the fabric is undesirable from a marketing standpoint. Uniformity is produced on a shuttle loom in that common picots are formed since both edges are woven. Thus, if uniformity of picot on both edges of a fabric is desired, one has to settle with forming them on a shuttle loom which operates slower than the needle loom, thereby increasing the cost of manufacturing.

The knitted threads on the knitted edge of the fabrics are held secure against the edge warp thread by the weft loops. For a picot of, for example, five or more in a set, the knitted thread lies loose and possibly separated from the warp edge. This condition is undesirable. Similarly, the knitted thread forms what appears to be a cover of the exterior edge of the edge warp thread, whereas no cover is provided on the woven edge. Again, the dissimilarity between the woven and knitted edge is undesirable in certain applications.

SUMMARY OF THE INVENTION

An object of the present invention is to provide a double picot fabric wherein both edges have French picots.

Another object of the present invention is to provide a woven fabric having French picots on each edge and formed on a needle loom.

A further object of the present invention is to provide a fabric having a picot along the knitted edge with the knitted thread secured to the fabric edge.

Still another object of the present invention is to provide a fabric produced on a needle loom wherein the woven edge has an edge covering similar to the knitted edge.

These and other objects are attained by providing in the weaving process a covering thread opposite the woven edge positioned in a opposite shed position from the edge warp thread. The final woven fabric results in the cover thread covering the exterior edge of the edge warp thread by a serpentine pattern interlocked with the weft loops at that edge. The serpentine cover thread causes the picot loops at the woven edge to lie diagonally. Thus, the woven edge of the fabric is identical to the knitted edge of the fabric wherein the picot loops of both edges are extending diagonally or flaired therefrom and the exterior edge of both fabric edges are covered. The knitted binder thread at the knitted edge is secured to the warp edge by a non-picot weft loop substantially at the center of a plurality of picot loops. The resulting fabric may be produced economically on a needle loom.

Other objects, advantages, and novel features of the present invention will become apparent from the following detailed description of the invention when considered in conjunction with the accompanying drawings.

BRIEF DESCRIPTION OF THE DRAWINGS

FIG. 1 is a plan view of the woven edge of a fabric on a loom incorporating the principles of the present invention.

FIG. 2 is a side elevation of a portion of the woven edge of a fabric incorporating the principles of the present invention.

FIG. 3 is a plan view of the knitted edge of the fabric on a loom.

FIG. 4 is a plan view of a fabric incorporating the principles of the present invention.

DESCRIPTION OF THE PREFERRED EMBODIMENTS

A fabric incorporating the principles of the present invention is preferably formed on a needle loom. The weft needle insertion side of the fabric as illustrated in FIG. 1 includes a shed 10 represented by warp thread 12 and 14 with thread 14 forming the edge thread. Adjacent to the edge thread 14 is an edge wire 16, a covering thread 18, and a picot wire 20. The weft insertion needle 22 inserts the weft thread 24 through the shed 10 to form edge weft loops 26, 28 and 30 and weft picot loops 32, 34, 36, and 38.

The loom is set up such that warp thread 12 and cover thread 18 are at an opposite position in the shed from edge warp thread 14. The edge wire 16 is laid into the shed and is carried by the edge warp thread 14. The picot wire 20 is independently operated in the shed so as to lie in a single shed position during the formation of the edge warp loops 26, 28, and 30, and to be raised and lowered during the formation of the picot weft loops 32, 34, 36, and 38, whereby the weft thread 24 is wrapped around the picot wire 20 and retained at a position spaced from the edge of the fabric defined by edge wire 16.

During a normal or selvage cycle of operation, the weft needle 22 is inserted past covering thread 18 and edge wire 16 through the shed 10 to the other side wherein it is engaged and held in place at the other side by a knitted binder thread and thereafter returns to the first edge. The shed is then reversed and the cycle is repeated. If, for example, the edge warp thread 14 is in a raised position with edge wire 16, the warp thread 12 and cover thread 18 are in the lower position. As the weft needle 22 reverses at the first edge after the previous shed change, the weft thread forms loop 26 and weft portion 37 is laid therein. Upon the reverse motion or return to the first edge, weft thread 39 is laid therein. Once the weft needle 22 is returned to its original position, the shed is reversed and the weft needle begins another cycle entering the shed 10 under cover thread 18 over edge wire 16 and warp thread 14 and under warp thread 12 forming thereby weft loop 28. During the cycle the picot wire 20 is maintained in a fixed position in the shed being up or down, and thus, the weft thread 24 will not wrap around or engage the picot wire 20.

As can be seen from viewing weft loops 26, 28, and 30, the weft thread forms a figure 8 configuration around the covering thread 18 and the edge warp thread 14. Although the edge wire 16 has been described as being laid in and following the position in the shed of edge warp 14, this is merely a matter of choice and it may be laid in the shed and follow the shed position of the cover thread 18.

At the part of the program where picot weft loops are to be formed on the woven side, the picot wire 20 is controlled to change its position at the reversal of the shed. As illustrated, picot wire 20 is operated to follow the position of the cover wire 18 opposite the edge wire 16 and the edge warp thread 14. As with the edge wire 16, the picot wire's position in the shed relative to cover thread 18 or edge warp thread 14 is a matter of design and may be opposite that illustrated. Similarly, it should be noted that the use of a picot wire 20 as part of the shed and operated by the reverse of the shed is but one example of a method and device for forming the woven edge picot loops. Other devices may be used depending upon the machine, as disclosed in the two patents discussed previously.

The major difference between the aforementioned description and the standard operation of a needle loom is the inclusion of a cover thread 18 exterior the edge warp thread 14 and being positioned in the shed in an opposite position from the edge warp thread 14. Although the cover thread 18 is illustrated as being positioned exterior the edge wire 16, obviously it may be provided between the edge wire 16 and the edge warp thread 14. The importance of the opposite positioning in the shed of cover thread 18 and edge warp thread 14 will be discussed relative to the illustration of FIG. 2. From the side of the fabric, the edge warp thread 14 appears to be covered. Upon close examination, it is revealed that the cover thread 18 assumes a serpentine or sinusoidal configuration covering the external edge of the warp thread 14. Because the cover thread 18 is at an opposite position in the shed from edge thread 14, the external weft loops cannot assume a vertical position when beaten up by the reed of the loom. The presence of the cover thread 18 prevents adjacent weft loops, for example, 26 and 28, from being positioned totally vertically and adjacent to each other. As illustrated in FIG. 2, two thicknesses of the cover thread 18 are present between two weft edge loops 26 and 28. Thus, to the naked unskilled eye, the serpentine pattern of the cover thread 18 appears to cover the edge of the edge warp thread 14. This would not result if the cover thread 18 was positioned in the shed at the same position, namely, raised or lowered, as the edge thread 14. Such common positioning would just cause the cover thread 18 to lie adjacent the edge warp thread 14 and not cover it.

The presence of the cover thread 18 as just described prevents the exterior weft loops on the woven side from assuming a vertical position. This is a desired effect, especially with respect to picot loops 32, 34, 36, and 38. By not allowing these loops to assume a vertical position, they lie diagonally across the edge of the fabric resulting in flaired or French picot loops. The formation of a flaired or French picot loop on the woven side of a fabric has heretofore been impossible. Thus, the position of the cover thread 18 opposite the position of the edge warp thread 14 in the shed not only provides a covering for the warp edge thread 14, but also produces flaired or French picot loops at the woven edge of a fabric. The operation of the cover thread 18 and the flair of the picot loops is even accented further by the use of an elastomeric as the warp edge thread 14. As the material is removed from the loom, the elastomeric, which is under tension in the shed, will contract and thereby further compress the cover thread 18 and the weft loops 26, 28, 30, 32, etc., along the length of the fabric. The alternate weave of the cover thread 18 relative to the edge thread 14 also produces a gripping of the lower portion of the picot loops 32, 34, 36, and 38 during the contraction of the elastomeric warp thread 14 to pinch them together at their bases. This further increases the flair of the picot loops in addition to the flair produced by the diagonal positioning.

The emphasis so far has been with the weft insertion edge or the woven edge of the fabric, since the desirability of the present invention is to duplicate the covering effect and the flaired or French picot effect of the knitted edge of the fabric. On the knitted edge of the fabric as illustrated in FIG. 3, the loom includes a knitting needle 40 and a weft thread deflector 42. It should be noted that the latch on the knitting needle 40 has been omitted in the drawings for sake of clarity. Exterior the edge warp 43 is a binder thread 44 positioned by a movable positioning element 46 and a lock thread 48 fixedly positioned by an eyelet 50. By way of example, the binding of the weft thread 24 uses the technique of the binder thread 44 being knitted upon itself and about the weft thread 24 while the lock thread 48 is knitted upon itself without interlooping the weft thread 24. This is but one example of the type of knitting which may be used on the knitted side of the structure. Any or all other methods described in the Background of the Invention may be used, depending upon the application and the desirability of the ravel proofness of the fabric. Machines which are capable of producing this pattern are illustrated in Offenlegungsschrift Nos. 2,637,618 dated Jan. 12, 1978, and 2,727,290 dated Feb. 23, 1978.

A portion of the fabric illustrated in FIG. 3 includes picot loops 52 and 54 with a non-picot loop 56. As can be seen, the binder thread 44 interloops and loops around the weft thread 24, and thus, as on the other side, causes the picot loops formed by the weft thread to lie diagonally across the edge of the edge warp thread 43 and to have its base pinched together so as to form a flaired or French picot along the knitted edge. This is well known in the prior art. Similarly, the knitted binder thread 44 and lock thread 48 form a covering along the external edge of edge warp thread 43. As stated previously, it is the French picot and the covered warp edge thread of the knitted side which the present invention was designed to duplicate on the woven side.

When the picot loops are formed in a series of, for example, four or more, the knitted binder thread 44 and lock thread 48 lie loose and separate from the edge warp thread 43. This provides for an unsightly appearance and is undesirable. The fabric illustrated in FIG. 3 incorporates the non-picot loop 56 substantially in the center of a picot series to bind the knitted binder thread 44 and lock thread 48 to the edge warp thread 43. Thus, in FIG. 3, two or more additional picot loops would be formed such that the non-picot loop 56 is substantially in the center. Depending upon whether an even or an odd number of picot loops in a series are desired, the non-picot loop would divide the picots into two groups of equal numbers, for an even sum of the two groups or divide them into two groups or unequal numbers, where the number in one group differs from the number in the other group by one, for an odd sum of the two groups.

A fabric 60 produced by the present methods is illustrated in FIG. 4. The woven edge 62 includes a plurality of groups of picot loops 64 extending diagonally therefrom and separated by a plurality of groups of selvage loops 66. The knitted edge 68 includes a plurality of groups of picot loops 70 extending diagonally therefrom and separated by a plurality of groups of selvage loops 72. Each group of picot loops 70 include a first and second set of picot loops 74 and 76 separated by a selvage loop 78. The selvage loop 78 bind the knitted binder and lock thread to the knitted edge 68. For example, groups 64 and 66 include four and five loops, respectively, group 72 includes four loops, and group 70 include five loops, and two loops in sets 74 and 76 and loop 78.

Although warp threads 12 and 14, and 43 and 41 are shown at opposite positions in the shed to show an interweaving of the weft thread relative to the warp threads, this is for the purpose of illustration. The thread 14 may represent a plurality of adjacent threads having the same position in the shed and 12 may represent the next plurality of threads in the opposite position in the shed. Thus, for example, if the fabric is a narrow stretch fabric, thread 14 may represent an elastomeric thread positioned between a plurality of non-elastomeric threads. The picot loops on the woven edge may be formed in the same cycle as the picot loops on the knitted edge. Alternately, the series of picot loops on one edge may be formed with non-picot or selvage loops on the opposite edge.

From the preceding description of the preferred embodiments, it is evident that the objects of the invention are attained in that a double picot fabric having French picot and covering on both edges is formed on a needle loom. Although the invention has been described and illustrated in detail, it is to be clearly understood that the same is by way of illustration and example only and is not to be taken by way of limitation. The spirit and scope of this invention are to be limited only by the terms of the appended claims.

What is claimed:

1. A method for weaving a fabric comprising:

providing a warp shed with a cover thread and a first edge wire adjacent a first edge warp thread of said shed, said cover thread and said first edge warp thread being in opposite positions in said shed;

inserting a weft thread through said warp shed from said first edge to form a weft loop at said first edge;

returning said weft thread to said first edge to form a weft loop at said second edge;

knitting a binder thread about said weft loop to bind said weft loop at said second edge;

reversing said warp shed; and repeating aforementioned steps to form a fabric having a first edge warp thread covered on its exterior edge by a serpentine patterned cover thread and having a second edge warp thread covered on its exterior edge by said knitted binder thread.

2. A method according to claim 1, wherein said first edge wire is positioned in said shed opposite the shed position of said cover thread.

3. The method according to claim 1 wherein said first edge wire is positioned between said cover thread and said first edge warp thread.

4. The method according to claim 1 wherein said first edge warp thread is an elastomeric.

5. The method according to claim 1 wherein said aforementioned steps constitute a selvage cycle; and including a picot cycle which is said selvage cycle with the additional step of engaging and maintaining said weft loop at said first edge spaced from said first and said first edge wire to form a picot loop at said first edge; said serpentine patterned cover thread causes said picot loop to extend from said first edge diagonally.

6. The method according to claim 5 wherein said picot cycle includes an additional step of engaging and maintaining said weft loop at said second edge spaced from said second edge to form a picot loop at said second edge.

7. The method according to claim 6 wherein said knitting step includes knitting a lock thread at said second edge, said knitted binder and lock threads cause said picot loop to extend from said second edge diagonally.

8. The method according to claim 5 wherein said second edge warp thread is elastomeric.

9. A woven fabric comprising:

a plurality of warp threads including a first edge warp thread and a second edge warp thread;

a weft thread interwoven with said plurality of warp threads and bound at a first edge by looping around said first edge warp thread and at said second edge by a knitted binder thread;

a first plurality of weft picot loops diagonally extending from said first edge;

a second plurality of weft picot loops diagonally extending from said second edge;

said knitted binder thread covering the exterior edge of said second edge warp thread and causing said second plurality of picot loops to extend diagonally; and a cover thread forming a serpentine pattern about said weft thread loops at said first edge in an opposite fashion to said first edge warp, covering the exterior edge of said first edge warp thread and causing said first plurality of picot loops to extend diagonally such that said two edges appear substantially similar.

10. The woven fabric according to claim 9 wherein said first and second edge warp threads are elastomeric.

11. A woven fabric according to claim 9, wherein said first plurality of weft picot loops are aligned opposed said second plurality of weft picot loops.

12. In a method of weaving a fabric with picot loops along a knitted selvage edge including inserting a weft thread through a warp shed from a woven edge to form a weft loop at said woven edge, returning said weft thread to said woven edge to form a weft loop at a knitted edge, knitting a binder thread about said weft loop to bind said weft loop at said knitted edge, reversing said shed, said aforementioned steps constitute a selvage cycle, performing a first plurality of selvage cycles to form a first plurality of weft loops about the selvages at said knitted edge followed by an additional plurality of cycles to form a first plurality of picot loops at said knitted edge, a picot cycle being said selvage cycle including the step of engaging and maintaining said weft loop spaced from said knitted edge to form a picot loop, said plurality of selvage and picot cycles being alternated to form said fabric, the improvement being in performing said first plurality of picot cycles which comprises performing a second plurality of picot cycles to form a second plurality of picot loops, performing a selvage cycle to secure the knitted threads to said knitted selvage and performing a third plurality of picot cycles to form a third plurality of picot loops.

13. The method of weaving according to claim 12 wherein the sum of said second and third pluralities of picot loops is equal to said second plurality of picot loops.

14. The method of weaving according to claim 12 wherein said second and third pluralities of picot loops differ by no more than one.

15. The method of weaving according to claim 12 wherein said picot cycle includes the step of engaging and maintaining a weft loop formed at said woven edge spaced from said woven edge to form a picot loop.

16. The method of weaving according to claim 12 wherein said selvage cycle includes for the first plurality of selvage cycles only the step of engaging and maintaining a weft loop formed at said woven edge spaced from said woven edge.

17. The method of weaving according to claim 12 including the step of knitting a lock thread about the weft thread at said knitted edge.

18. A woven fabric comprising:

a plurality of warp threads;

a weft thread interwoven with said plurality of warp threads and bound at a first edge by looping around a warp thread and at a second edge by a knitted binder thread;

said weft thread forming at said second edge a repeating pattern of a first plurality of substantially equal length picot loops spaced from said second edge, a single loop engaging said second edge to secure the knitted binder thread to said second edge, a second plurality of substantially equal length picot loops spaced from said second edge, a third plurality of loops engaging said second edge, and a fourth plurality of substantially equal length picot loops spaced from said second edge, said second and fourth plurality of picot loops being visibly separated by said third plurality of loops.

19. A woven fabric according to claim 18 wherein said weft thread forms at said first edge a repeating pattern of a fifth plurality of loops engaging said first edge and a sixth plurality of picot loops spaced from said first edge.

20. A woven fabric according to claim 19, wherein said sixth plurality of picot loops at said first edge are aligned opposed said first and second plurality of picot loops at said second edge.

21. The woven fabric according to claim 18 including a lock thread knitted at said second edge.

* * * * *